US006640738B2

(12) United States Patent
Pierce

(10) Patent No.: US 6,640,738 B2
(45) Date of Patent: Nov. 4, 2003

(54) BITT WITH ROTATABLE LINE-HANDLING SURFACE

(75) Inventor: Robert A. Pierce, 9526-4$^{th}$Ave. NE., Seattle, WA (US) 98115

(73) Assignee: Robert A. Pierce, Seattle, WA (US)

( * ) Notice: Subject to any disclaimer, the term of this patent is extended or adjusted under 35 U.S.C. 154(b) by 0 days.

(21) Appl. No.: 09/947,329

(22) Filed: Sep. 5, 2001

(65) Prior Publication Data

US 2003/0041790 A1 Mar. 6, 2003

(51) Int. Cl.$^{7}$ ..... B63B 21/04; B66D 3/08

(52) U.S. Cl. ..... 114/218; 254/395

(58) Field of Search ..... 114/101, 218, 114/220, 230.25, 230.26; 24/115 L, 129 R, 130; 254/394, 395; D8/356; D12/317

(56) References Cited

U.S. PATENT DOCUMENTS

| | | | | | |
|---|---|---|---|---|---|
| 16,992 | A | * | 4/1857 | Osgood | 254/395 |
| 78,964 | A | * | 6/1868 | Haskins | 114/218 |
| 458,855 | A | * | 9/1891 | Meinzer | 254/395 |
| 522,524 | A | * | 7/1894 | Hook | 114/101 |
| 2,098,238 | A | * | 11/1937 | Halpine | 114/101 |
| 2,458,573 | A | * | 1/1949 | Donahue | 254/395 |
| 3,112,097 | A | * | 11/1963 | Taylor | 254/397 |
| 3,270,705 | A | * | 9/1966 | Roeggen | 114/218 |
| 3,897,745 | A | | 8/1975 | Hutchings | |
| 4,109,603 | A | | 8/1978 | Guthmann | |
| 4,114,553 | A | | 9/1978 | Zidek | |
| 4,154,428 | A | * | 5/1979 | Merry | 114/218 |
| RE30,089 | E | * | 9/1979 | Declercq | 114/218 |
| 4,173,194 | A | | 11/1979 | McLaughlin | |
| 4,354,445 | A | | 10/1982 | Kafka | |
| 4,388,774 | A | * | 6/1983 | Thoemke | 114/255 |
| 4,479,453 | A | * | 10/1984 | Bonassi | 114/218 |
| 4,519,643 | A | | 5/1985 | Harris | |
| 4,648,159 | A | | 3/1987 | Dougherty | |
| 4,672,909 | A | | 6/1987 | Sweetsir | |
| 4,741,284 | A | | 5/1988 | Madison | |
| 4,763,595 | A | | 8/1988 | Shaffner | |
| 4,766,835 | A | | 8/1988 | Randall et al. | |
| 4,905,922 | A | | 3/1990 | Caillon et al. | |
| 4,912,816 | A | | 4/1990 | Brandt | |
| 4,920,680 | A | * | 5/1990 | Lindgren | 254/362 |
| 5,050,813 | A | | 9/1991 | Ishikawa et al. | |
| 5,116,260 | A | | 5/1992 | Upchurch | |
| 5,265,556 | A | | 11/1993 | Hall | |

(List continued on next page.)

FOREIGN PATENT DOCUMENTS

| | | | | |
|---|---|---|---|---|
| BE | 495662 | * | 9/1950 | 254/394 |
| DE | 89217 | * | 11/1896 | 114/101 |
| GB | 20092 | * | 11/1892 | 114/101 |

*Primary Examiner*—S. Joseph Morano
*Assistant Examiner*—Andrew Wright
(74) *Attorney, Agent, or Firm*—Black Lowe & Graham PLLC

(57) ABSTRACT

A bitt with a freely rotatable line-handling surface includes a frame having a first side and a second side. The first and second sides of the frame each include first and second ends, and the first and second sides of the frame are substantially planar. The first and second sides adjoin each other at the first ends and define an angle therebetween. The first and second sides of the frame are arranged for being attachable to a surface of a marine vessel at the second ends of the first and second sides of the frame. First and second shafts extend outwardly from the planes of the first and second sides of the frame, respectively. The first and second shafts each have a longitudinal axis. The axis of each of the first and second shafts extends approximately perpendicularly to the plane of the first and second sides of the frame. First and second rollers each have an axis, and the first and second rollers each define a bore along the axis of the respective roller. The bores of the first and second rollers are each arranged for receiving the first and second shafts therethrough. The first and second rollers are rotatably mounted about the first and second shafts such that the first and second rollers provide freely rotatable line-handling surfaces.

40 Claims, 6 Drawing Sheets

U.S. PATENT DOCUMENTS

| | | | |
|---|---|---|---|
| 5,279,243 | A | 1/1994 | Cole |
| 5,327,845 | A | 7/1994 | Cook |
| 5,397,197 | A | 3/1995 | Beavers |
| 5,598,805 | A | 2/1997 | Obrinski |
| 5,870,963 | A | 2/1999 | Alan |
| 5,878,684 | A | 3/1999 | Adams |
| 5,927,693 | A | 7/1999 | Hackl |
| 6,119,618 | A | 9/2000 | Giles |
| 6,125,779 | A | 10/2000 | Czipri |
| 6,234,101 | B1 | 5/2001 | Czipri |

* cited by examiner

BITT WITH ROTATABLE LINE-HANDLING SURFACE

FIELD OF THE INVENTION

This invention relates generally to marine deck equipment, and specifically to bitts.

BACKGROUND OF THE INVENTION

The use of marine deck equipment is well known for securing marine vessels to piers with mooring lines. In particular, bitts are used by line handlers to help the line handlers pull a marine vessel alongside a pier and secure the marine vessel to the pier. After a marine vessel is pulled alongside the pier, the line handler takes several round turns of the line around the bitt, thus securing the marine vessel alongside the pier.

Conventional bitts, however, present drawbacks. For example, when drawing a marine vessel alongside a pier, the line handler must be positioned in a bent-over body position instead of an erect body position. This limits the amount of the line handler's strength available for line-handling activities. In addition, a bent-over body position increases likelihood of back injury from line-handling activities. Further, a bent-over body position causes the hands of the line handler to be closer to the bitt than would an erect position, thus increasing likelihood of hand injury. Finally, a bent-over body position limits mobility of a line handler and reduces a line handler's situation awareness during potentially dangerous line-handling evolutions.

Conventional bitts include a static, non-movable line-handling surface. Friction between the mooring line and the line-handling surface of the bitt results in a significant amount of the line handler's energy being spent in overcoming friction. As a result, a significant portion of energy expended by the line handler is not translated into useful work, such as drawing the marine vessel alongside the pier.

Thus, there is an unmet need in the art for a bitt that permits a line handler to perform line-handling operations in an erect body position instead of a bent-over body position, and that permits much of the line handler's energy to be available for useful work in line-handling activities instead of being used to overcome friction.

SUMMARY OF THE INVENTION

The present invention is a bitt with a freely rotatable line-handling surface. The bitt of the present invention permits a line handler to perform line-handling activities in an erect body position instead of a bent-over body position. Further, the freely rotatable line-handling surface included in the bitt of the present invention allows much of the line handler's energy to be applied to useful work in drawing a marine vessel alongside a pier, instead of being wasted in overcoming line friction.

According to the present invention, a bitt includes a frame having a first side and a second side. The first and second sides of the frame each include first and second ends, and the first and second sides of the frame are substantially planar. The first and second sides adjoin each other at the first ends and define an angle therebetween. The first and second sides of the frame are arranged for being attachable to a surface of a marine vessel at the second ends of the first and second sides of the frame. First and second shafts extend outwardly from the planes of the first and second sides of the frame, respectively. The first and second shafts each have a longitudinal axis. The axis of each of the first and second shafts extends approximately perpendicularly to the plane of the first and second sides of the frame. First and second rollers each have an axis, and the first and second rollers each define a bore along the axis of the respective roller. The bores of the first and second rollers are each arranged for receiving the first and second shafts therethrough. The first and second rollers are rotatably mounted about the first and second shafts, such that the first and second rollers provide freely rotatable line-handling surfaces.

According to an aspect of the invention, the first and second rollers each have first and second end sections with a first outer diameter and a middle section with a second outer diameter. The first outer diameter is greater than the second outer diameter, such that the first and second ends of the rollers define shoulders. The shoulders advantageously prevent the mooring line from slipping off the roller.

According to another aspect of the invention, the first and second rollers are made of a slightly compressible material, such as polyurethane. The slight compressibility advantageously enables the mooring line to grip the roller and aid rotation of the roller. As a result, the mooring line does not slip along the roller, thus increasing the line handler's control over line-handling evolutions.

According to another aspect of the present invention, the first and second sides of the frame are substantially perpendicular to each other, such that the axes of the first and second rollers each define approximately 45-degree angles with the surface of the marine vessel. As a result, the line handler is able to perform line-handling evolutions in an erect body position instead of a bent-over body position.

Thus, the line handler is able to use more body strength than the line handler could use in either a bent-over body position or standing erect when using a prior art bitt, and is less susceptible to back injuries than in a bent-over body position. Also, the hands of the line handler are further from the bitt, thus reducing likelihood of hand injuries during line-handling evolutions. Finally, by performing line-handling evolutions in an erect body position, the line handler is able to achieve a higher situation awareness during potentially dangerous line-handling evolutions than is possible when the line handler is in a bent-over body position.

BRIEF DESCRIPTION OF THE DRAWINGS

The preferred and alternative embodiments of the present invention are described in detail below with reference to the following drawings.

DETAILED DESCRIPTION OF THE INVENTION

Figure 1:
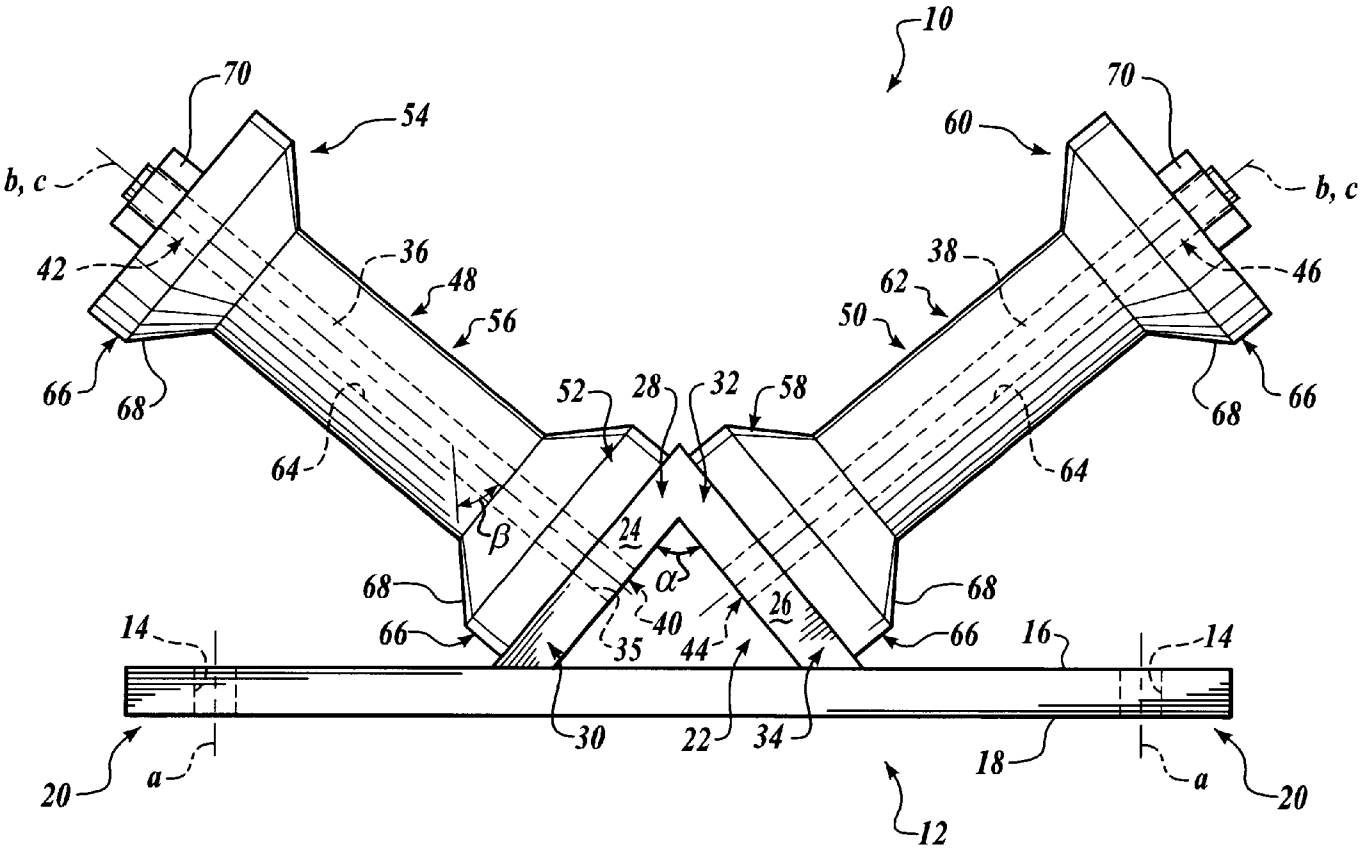
FIG. 1 is a side view of an embodiment of the invention.

FIG. 1 shows a bitt 10 with a freely rotatable line-handling surface according to the present invention. The bitt 10 permits a line handler to perform line-handling activities in an erect body position instead of a bent-over position.

Further, the freely rotatable line-handling surface included in the bitt 10 allows much of the line handler's energy to be applied to useful work in drawing a marine vessel along side a pier instead of being wasted in overcoming line friction.

Referring to FIG. 1, the bitt 10 includes a base 12. The base 12 is substantially planar and is suitably a rectangular base plate. The base 12 defines bores 14, shown in phantom, that extend through the base 12 from a top surface 16 of the base 12 to a bottom surface 18 of the base 12. The bores 14 each define an axis a in a direction that is perpendicular to the plane of the base 12. The bores 14 are sized to receive mounting hardware suitable for mounting the base 12 to a surface of a marine vessel (not shown). As is known in the art, the base 12 may be mounted on a deck at the marine vessel. However, it will be appreciated that the base 12 may be mounted on other surfaces of the marine vessel. For example, the base 12 may be mounted on a bulkhead. Mounting the base 12 on a bulkhead may be desirable to locate the bit 12 adjacent a chock. The bores 14 are suitably located toward end sections 20 of the base 12. The base 12 is suitably made from a plate of metal that is appropriate for mounting marine hardware to the deck of a marine vessel. The base 12 is therefore suitably made from stainless steel, such as #317 stainless steel. If desired, the base 12 may be plated with chrome to present an enhanced appearance.

A frame assembly 22 is attached to the top surface 16 of the base 12. The frame assembly 22 is generally an inverted "V"-shaped assembly. The frame assembly 22 includes a first frame member 24 and a second frame member 26. The first and second frame members 24 and 26 are generally planar. The first frame member 24 has a first end 28 and a second end 30, and the second frame member 26 has a first end 32 and a second end 34. The first and second frame members 24 and 26 are attached to each other at the first ends 28 and 32, respectively, and define an angle $\alpha$ that is preferably substantially 90 degrees. It will be appreciated that any angle $\alpha$ may be selected as desired for a particular line-handling application. It will also be appreciated that the frame assembly 22 may be made of unitary construction, such as from angle iron or the like, if desired. The second ends 30 and 34 of the first and second frame members 24 and 26, respectively, are attached to the top surface 16 of the base 12. The first and second frame members 24 and 26 are preferably attached to each other and to the top surface 16 of the base 12 by acceptable methods of joining metal, such as tungsten-inert-gas (TIG) welding or metal-inert-gas (MIG) welding. The frame assembly 22 is preferably centered on the base 12. That is, the first ends 28 and 32 of the first and second frame members 24 and 26 that form an apex of the inverted "V"-shaped frame assembly 22 are preferably positioned approximately midway between the end sections 20 of the base 12. The second ends 30 and 34 of the first and second frame members 24 and 26, respectively, are attached to the top surface 16 of the base 12 at points that are intermediate the midpoint of the base 12 and the bores 14. Thus, the frame assembly 22 is generally centered on the base 12, and the bores 14 are defined toward the end sections 20 of the base 12, such that line-handling forces are distributed substantially evenly about the frame assembly 22 and the base 12. Intermediate the first end 28 and second end 30 and intermediate the first end 32 and second end 34, the first and second frame members 24 and 26 define bores 35 that extend through the first and second frame members 24 and 26 along axes that are substantially perpendicular to the planes of the first and second frame members 24 and 26.

Figure 3:
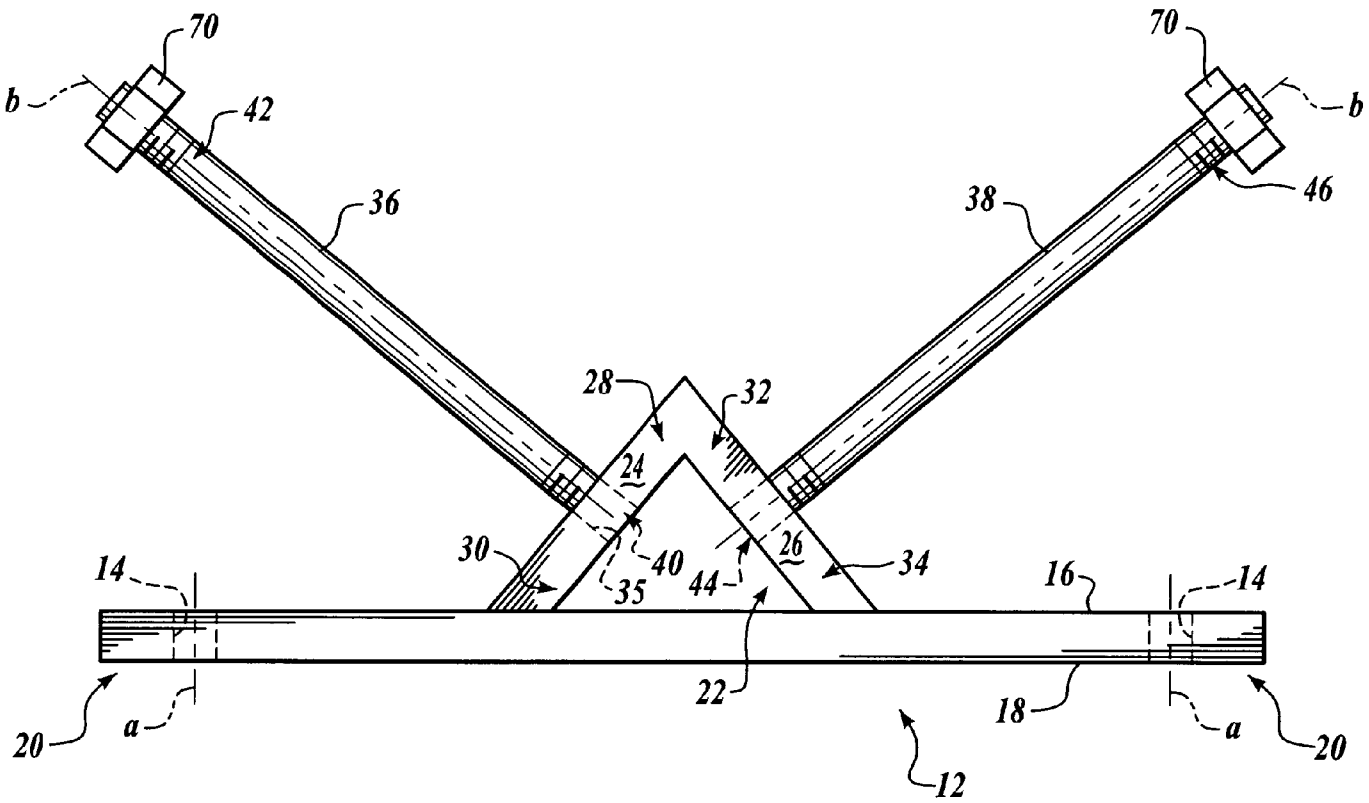
FIG. 3 is a side view of components of the invention.

Referring now to FIGS. 1 and 3, a first shaft 36 and a second shaft 38 extend outwardly from the planes of the first and second frame members 24 and 26, respectively. The first and second shafts 36 and 38 are suitably any shaft known in the art, such as a rod, a threaded rod, a bolt, or the like. The first and second shafts 36 and 38 are preferably made from the same material as the first and second frame members 24 and 26 to minimize possibility of inducing galvanic corrosion due to joints between dissimilar metals. The first and second shafts 36 and 38 each define an axis b. The first shaft 36 has a first end 40 and a second end 42, and the second shaft 38 has a first end 44 and a second end 46. The second ends 42 and 46 are received within the bores 35. The first and second shafts 36 and 38 are attached to the first and second frame members 24 and 26, respectively, such that the axes b of the first and second shafts 36 and 38 are substantially perpendicular to the plane of the first and second frame members 24 and 26. As such, the axes b each define approximately 45-degree angles with the plane of the base 12 when the angle $\alpha$ is approximately 90°. It will be appreciated that the angle $\alpha$ and the axes b cooperate to define the angle between the axes b and the plane of the base 12. As shown in FIG. 1, a 45-degree angle accommodates many entry angles between a marine vessel and a pier. However, the angles $\alpha$ and the axes b may be selected as desired for any application. The first and second ends 44 and 46 of the first and second shafts 36 and 38, respectively, are attached to the first and second frame members 24 and 26 in an acceptable manner known in the art. For example, the second ends 42 and 46 may be welded to the first and second frame members 24 and 26. When the shafts 36 and 38 are bolts, the heads of the bolts may be welded to the first and second frame members 24 and 26. Alternatively, the second ends 42 and 46 may be threaded, and the bores 35 are threaded and are arranged to threadedly receive and engage the second ends 42 and 46 of the first and second shafts 36 and 38. However, it will be appreciated that the second ends 42 and 46 are suitably attached to the first and second frame members 24 and 26 in any acceptable manner that is known in the art. As shown in FIG. 1. the first ends 40 and 44 of the first and second shafts 36 and 38. respectively, are unattached to any other structure.

The first and second shafts 36 and 38 each rotatably receive first and second rollers 48 and 50, respectively, that provide rotatable line-handling surfaces. The first and second rollers 48 and 50 each have a longitudinal axis c. The first roller 48 has a first end section 52, a second end section 54, and a middle section 56. The second roller 50 has a first end section 58, a second end section 60, and a middle section 62. The first and second rollers 48 and 50 each define longitudinal bores 64, shown in phantom, that extend from the first end sections 52 and 58 through the first and second rollers 48 and 50 to the second end sections 54 and 60. The bores 64 are sized to have a diameter that is slightly larger than a diameter of the first and second shafts 36 and 38.

The first end sections 52 and 58 and the second end sections 54 and 60 each define shoulders 66. Each of the shoulders 66 is preferably identical, and a description of the shoulder 66 at the first end section 52 of the first roller 48 is representative of all the shoulders 66. The first end section 52 defines a first outer diameter. The first outer diameter is substantially constant and extends a finite distance d laterally toward the middle section 56. The middle section 56, the outer diameter of the first roller 48 decreases along the finite distance d, preferably constantly, to a second outer diameter that is less than the first outer diameter. In one embodiment of the invention, the constant decrease in the outer diameter of the first roller 48 defines a shoulder surface 68 that defines an angle $\beta$ with the axis c. In one embodiment of the invention, the angle β is approximately 45 degrees. It will be appreciated that the angle β can be any angle as desired. Alternate embodiments of the present invention that vary the angle β are discussed later.

The first and second rollers 48 and 50 are each suitably constructed of a compressible material, such as polyurethane, or the like. According to the invention, slight compressibility of the first and second rollers 48 and 50 permits the mooring line to grip the first roller 48 or the second roller 50, as desired. A readily available roller, for example, is the RP-5, available from the Stoltz Company. However, it will be appreciated that the first and second rollers 48 and 50 may be made of other suitable materials. For example, the first and second rollers 48 and 50 may be made from the same material used for the first and second shafts 36 and 38. In this alternate embodiment, exterior surfaces of the first and second rollers 48 and 50 are treated in any acceptable known manner to provide non-skid surfaces to permit mooring lines to grip the line-handling surfaces of the first and second rollers 48 and 50.

The first and second shafts 36 and 38 receive the bores 64 of the first and second rollers 48 and 50, respectively. Thus, the first and second rollers 48 and 50 are rotatably mounted on the first and second shafts 36 and 38 such that the axes c are aligned with the axes b. Because the diameter of the bores 64 is slightly greater than the diameter of the first and second shafts 36 and 38, the first and second rollers 48 and 50 freely rotate about the axes c. Retainers 70 are placed on the second ends 42 and 46 of the first and second shafts 36 and 38, respectively, and retain the first and second rollers 48 and 50 on the first and second shafts 36 and 38, respectively. The retainers 70 are acceptably any retainer known in the art, such as a locknut, a pin, a cotter pin, or the like. When the retainer 70 is a locknut, the second ends 42 and 46 of the first and second shafts 36 and 38 are threaded, and the retainers 70 are threadedly received about the second ends 42 and 46 of the first and second shafts 36 and 38. As shown in FIG. 1, the second end sections 54 and 60 are unattached to any other structure.

Figure 4:
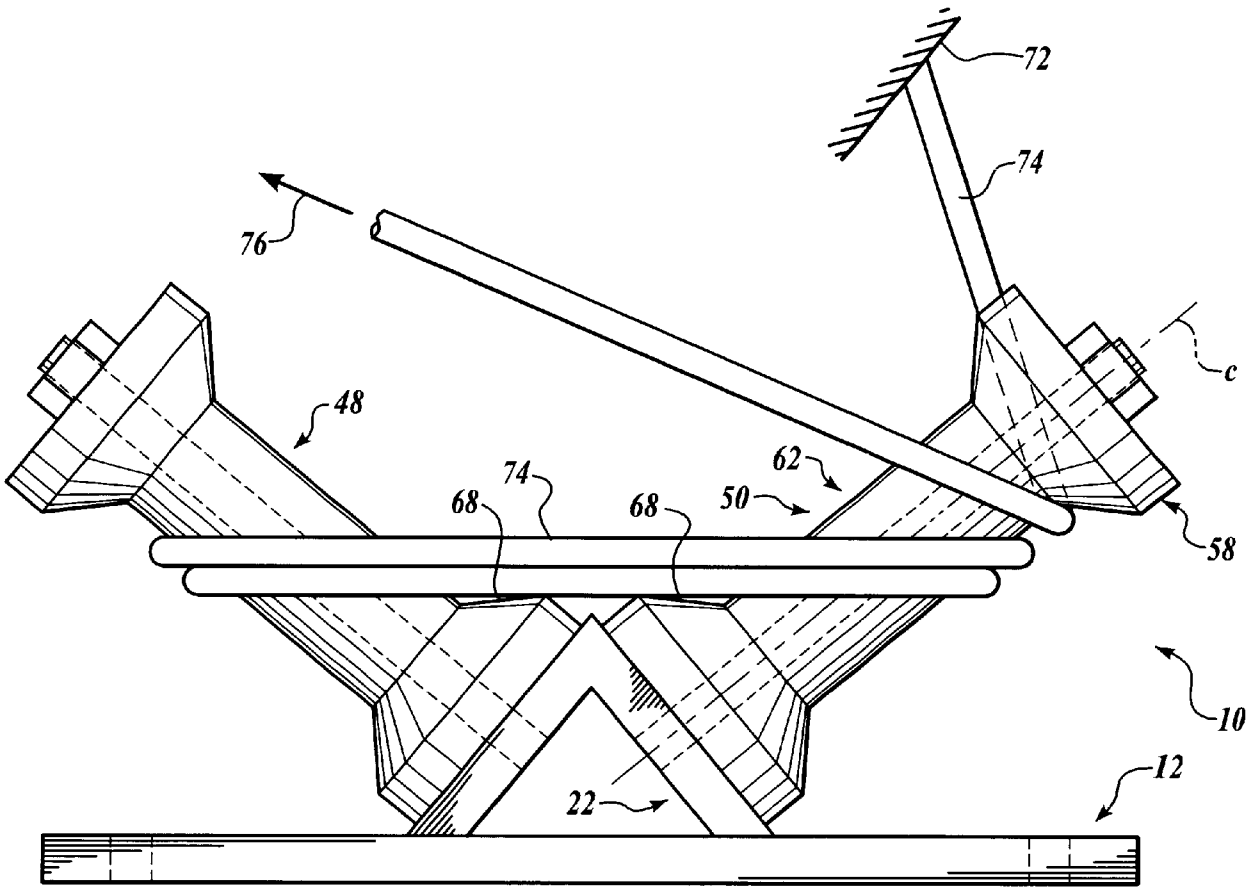
FIG. 4 is a side view of the invention in use.

Use of the invention will be explained referring now to FIG. 4. As a marine vessel (not shown) approaches a pier 72, a mooring line 74 is secured to the pier 72. The line handler (not shown) gives the mooring line 74 a half-turn around one of the first and second rollers 48 and 50, as desired. As shown by way of non-limiting example in FIG. 4, the mooring line 74 is given a half-turn around the second roller 50. It will be appreciated that when the mooring line 74 is given a half-turn on the shoulder 66, any pier-side entry angle of the mooring line 74 can be accommodated because, as shown in FIG. 4, the second end sections 54 and 60 are unattached to any other structure. Because the first outer diameter at the first end section 58 is greater than the second outer diameter at the middle section 62, the mooring line is prevented from slipping off the second end 60 of the second roller 50. The line handler (not shown) pulls the mooring line 74 in a direction denoted by an arrow 76. Because of compressibility of the roller 50, the mooring line 74 grips the surface of the roller 50, and the roller 50 rotates about the axis c. Because the roller 50 rotates about the axis c, much of the energy by the line handler (not shown) is translated into useful work in drawing the marine vessel (not shown) to the pier 72.

Still referring to FIG. 4, according to the invention the bitt 10 is used when the marine vessel (not shown) is tied to the pier 72. One end of the mooring line 74 is secured to the pier 72. The mooring line 74 is given turns as desired around the first and second rollers 48 and 50. A bottom turn of the mooring line 74 rests upon the shoulder surfaces 68 at the first end sections 52 and 58 of the first and second rollers 48 and 50. It will be appreciated that the shoulder surfaces 68 are substantially parallel to the plane of the base 12. Thus, the shoulder surfaces 68 prevent the mooring lines 74 from slipping off the first and second rollers 48 and 50.

Figure 2:
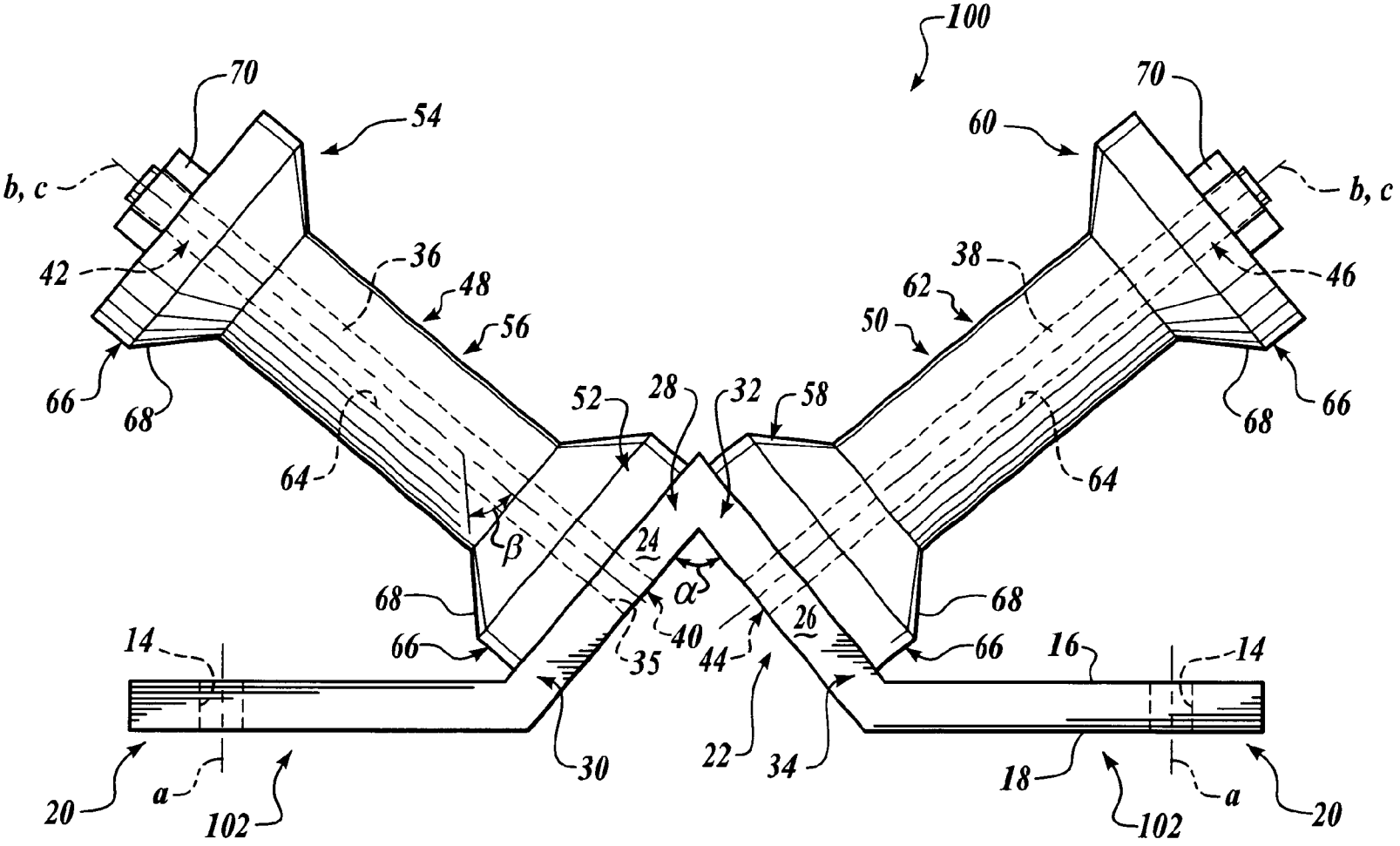
FIG. 2 is a side view of an alternate embodiment of the invention.

Referring now to FIG. 2, an alternate embodiment of the invention is shown. A bitt 100 includes a frame assembly 22, first and second shafts 36 and 38, first and second rollers 48 and 50, and retainers 70 as described above for the embodiment shown in FIG. 1. However, in this alternate embodiment, the frame assembly 22 includes extensions 102 that are similar to the end sections 20 of the base 12 of the embodiment of FIG. 1. As such, the extensions 102 define the bores 14 as in the embodiment shown in FIG. 1. However, it will be appreciated that the bitt 100 provides a unitary frame assembly with extensions for mounting the bitt 100 to the deck of a marine vessel (not shown). Alternatively, instead of a unitary construction, the extensions 102 may be attached to the frame assembly in any acceptable, known manner, such as welding as described above for the bitt 10.

Figure 5:
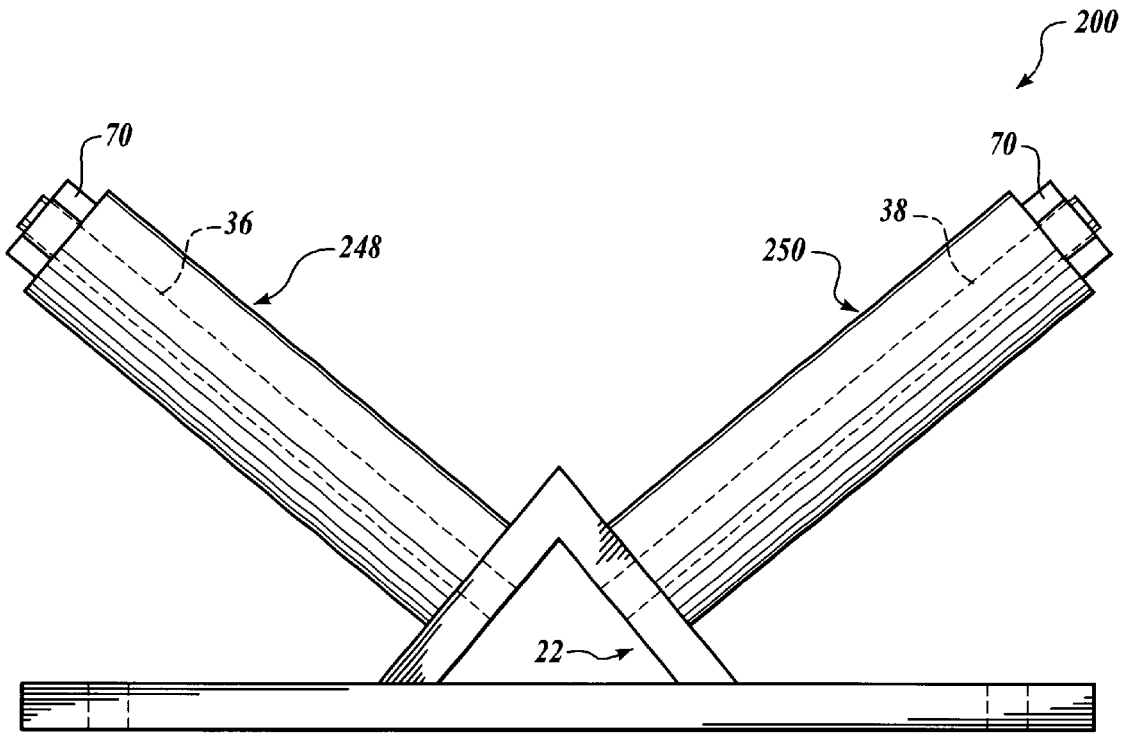
FIG. 5 is a side view of an alternate embodiment of the invention.

Referring now to FIG. 5, another alternate embodiment of the invention is shown. A bitt 200 includes a frame assembly 22, first and second shafts 36 and 38, and retainers 70 as described above for the embodiment shown in FIG. 1. However, in this alternate embodiment, first and second rollers 248 and 250 each define substantially constant outer diameters. It will be appreciated that the bitt 200 may be desirable in applications where space constraints indicate that rollers without shoulders may be desirable.

Figure 6:
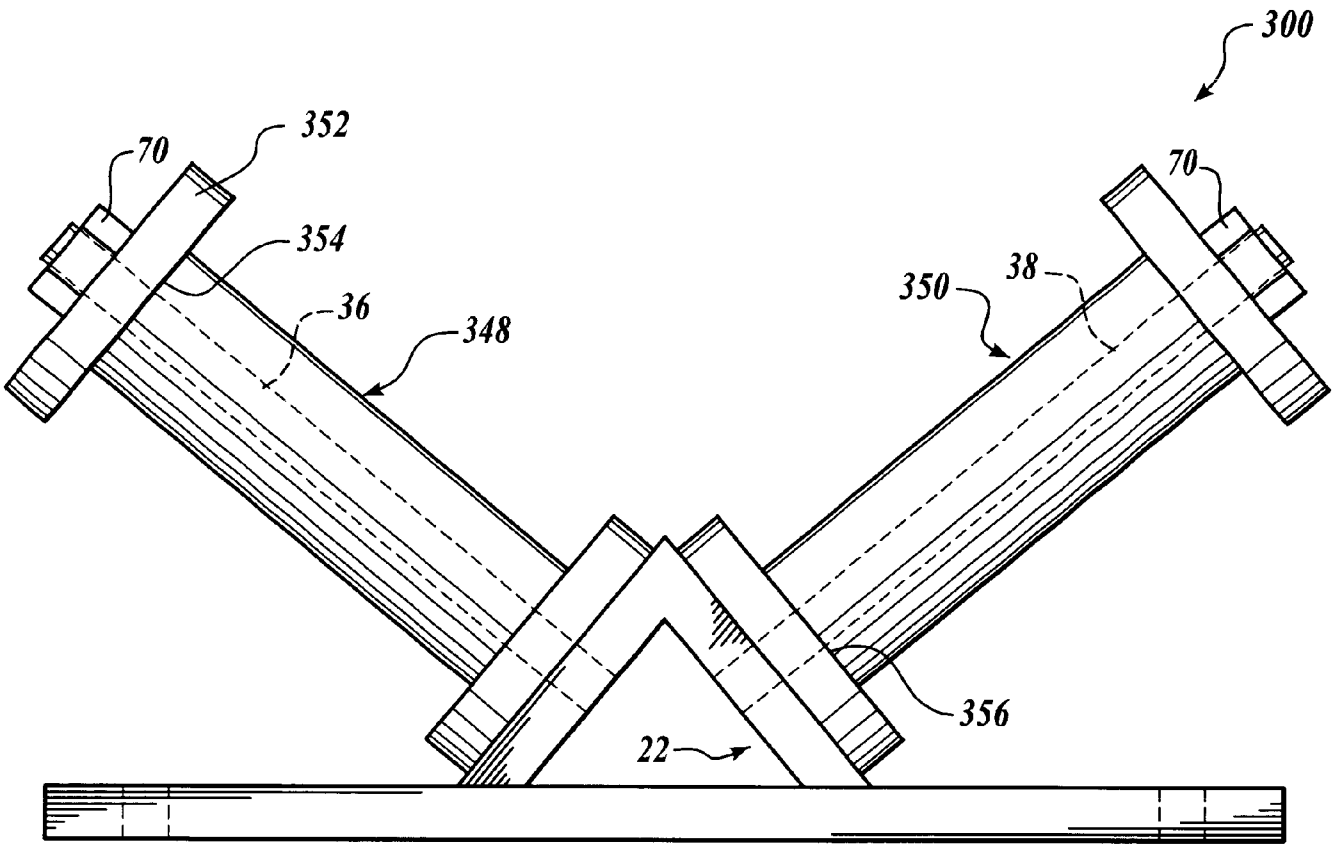
FIG. 6 is a side view of another alternate embodiment of the invention.

Referring now to FIG. 6, a further alternate embodiment of the invention is shown. A bitt 300 includes a frame assembly 22, first and second shafts 36 and 38, and retainers 70 as described for the embodiment shown in FIG. 1. In this alternate embodiment, first and second rollers 348 and 350 each define substantially constant outer diameters. However, the rollers 348 and 350 each define flanges 352 at each end. The flanges 352 extend from first and second ends 354 and 356 of the rollers 348 and 350 substantially perpendicular to the axes of the rollers 348 and 350. The flanges 352 provide a shoulder-like surface for retaining a mooring line on the roller. It will be appreciated that use of the rollers 348 and 350 may be desirable in applications similar to applications for the rollers 248 and 250.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A bitt with a freely rotatable line-handling surface, comprising:

a frame having a first side and a second side, the first side and the second side having first and second ends and being substantially planar, the first and second sides adjoining each other at their first ends and forming a non-zero angle therebetween, the first and second sides being arranged for being attachable to a surface of a marine vessel at the second end;

first and second shafts each extending outwardly at a first end from the planes of the first and second sides of the frame, respectively, each of the first and second shafts having a longitudinal axis that extends approximately perpendicularly to the planes of the first and second sides of the frame, the first and second shafts having second ends attached to first and second retainers, respectively, and unattached to any other structure; and first and second rollers, each of the first and second rollers having an axis, each of the first and second rollers defining a bore along its axis, the bores of the first and second rollers being arranged for receiving the first and second shafts therethrough, respectively, the first and second rollers being rotatably mounted about the first and second shafts such that the first and second rollers provide freely rotatable line-handling surfaces.

2. The bitt of claim 1, wherein the first and second rollers have substantially constant outer diameters.

3. The bitt of claim 2, wherein the first and second rollers have first and second ends, the first and second rollers including flanges at their first and second ends, the flanges extending substantially perpendicular to the axes of the rollers.

4. The bitt of claim 1, wherein the second ends of the first and second shafts are threaded, and the first and second retainers are threadedly received about the second ends of the first and second shafts.

5. The bitt of claim 1, wherein the rollers are made of a compressible material.

6. The bitt of claim 5, wherein the compressible material is polyurethane.

7. The bitt of claim 1, wherein the angle formed between the first and second sides is approximately 90 degrees.

8. The bitt of claim 1, wherein the frame is made of unitary construction.

9. The bitt of claim 1, wherein the first side of the frame and the second side of the frame are separate members.

10. The bitt of claim 1, wherein the frame includes first and second mounting flanges attached to the second ends of the first and second frame members, the mounting flanges being arranged for mounting the frame assembly to the surface of a marine vessel.

11. The bitt of claim 1, further comprising a base, the base being arranged for mountably receiving the frame assembly on an upper surface of the base, the base having a lower surface that is arranged for being mounted on the surface of a marine vessel.

12. A bitt with a freely rotatable line-handling surface, comprising:

a substantially planar base having an upper surface and a lower surface, the lower surface being arranged for being mounted on a surface of a marine vessel;

a frame having first and second substantially planar sides, the first and second sides having first and second ends, the first and second sides adjoining each other at their first ends and forming a non-zero angle therebetween, the first and second sides being attached to the upper surface of the base at the second ends;

first and second shafts each having first and second ends and an axis, the first and second shafts being attached to the first and second sides at the first ends of the shafts, the axes of the first and second shafts extending outwardly from the first and second sides substantially perpendicular to the planes of the first and second sides, the second ends of the first and second shafts being attached to first and second retainers, respectively, and being unattached to any other structure; and first and second rollers each having an axis, each of the first and second rollers defining a bore along its axis, the bores of the first and second rollers being arranged for receiving the first and second shafts therethrough, respectively, the first and second rollers being rotatably mounted about the first and second shafts such that the first and second rollers provide freely rotatable line-handling surfaces.

13. The bitt of claim 12, wherein the first and second rollers have first and second end sections with a first outer diameter and a middle section with a second outer diameter, the first outer diameter being greater then the second outer diameter such that the first and second ends of the first and second rollers define shoulders.

14. The bitt of claim 12, wherein the first and second rollers have substantially constant outer diameters.

15. The bitt of claim 14, wherein the first and second rollers have first and second ends, the first and second rollers including flanges at their first and second ends, the flanges extending substantially perpendicular to the axes of the rollers.

16. The bitt of claim 12, wherein the second ends of the first and second shafts are threaded, and the first and second retainers are threadedly received about the second ends of the first and second shafts.

17. The bitt of claim 13, wherein the rollers are made of a compressible material.

18. The bitt of claim 17 wherein the compressible material is polyurethane.

19. The bitt of claim 12, wherein the angle formed between the first and second sides is approximately 90 degrees.

20. The bitt of claim 12, wherein the frame is made of unitary construction.

21. The bitt of claim 12, wherein the first side of the frame and the second side of the frame are separate members.

22. A bitt with a freely rotatable line-handling surface, comprising:

a frame having a first side and a second side, the first side and the second side having first and second ends and being substantially planar, the first and second sides adjoining each other at their first ends and forming a non-zero angle therebetween, the first and second sides being arranged for being attachable to a surface of a marine vessel at the second end;

first and second shafts each extending outwardly at a first end from the planes of the first and second sides of the frame, respectively, each of the first and second shafts having a longitudinal axis that extends approximately perpendicularly to the planes of the first and second sides of the frame, the first and second shafts having second ends attached to first and second retainers, respectively, and unattached to any other structure; and first and second rollers, each of the first and second rollers having an axis, each of the first and second rollers defining a bore along its axis, the bores of the first and second rollers being arranged for receiving the first and second shafts therethrough, respectively, the first and second rollers having first and second end sections with a first outer diameter and a middle section with a second outer diameter, the first outer diameter being greater then the second outer diameter such that the first and second ends of the first and second rollers define shoulder, the first and second rollers being rotatably mounted about the first and second shafts such that the first and second rollers provide freely rotatable line-handling surfaces.

23. The bitt of claim 22 wherein the second ends of the first and second shafts are threaded, and the first and second retainers are threadedly received about the second ends of the first and second shafts.

24. The bitt of claim 22, wherein the rollers are made of a compressible material.

25. The bitt of claim 24, wherein the compressible material is polyurethane.

26. The bitt of claim 22, wherein the angle formed between the first and second sides is approximately 90 degrees.

27. The bitt of claim 22, wherein the frame is made of unitary construction.

28. The bitt of claim 22, wherein the first side of the frame and the second side of the frame are separate members.

29. The bitt of claim 22, wherein the frame includes first and second mounting flanges attached to the second ends of the first and second frame members, the mounting flanges being arranged for mounting the frame assembly to the surface of a marine vessel.

30. The bitt of claim 22, further comprising a base, the base being arranged for mountably receiving the frame assembly on an upper surface of the base, the base having a lower surface that is arranged for being mounted on the surface of a marine vessel.

31. A bitt with a freely rotatable line-handling surface, comprising:

a substantially planar base having an upper surface and a lower surface, the lower surface being arranged for being mounted on a surface of a marine vessel;

a frame having first and second substantially planar sides, the first and second sides having first and second ends, the first and second sides adjoining each other at their first ends and defining a non-zero angle therebetween, the first and second sides being attached to the upper surface of the base at the second ends;

first and second shafts each having first and second ends and an axis, the first and second shafts being attached to the first and second sides at the first ends of the shafts, the axes of the first and second shafts extending outwardly from the first and second sides substantially perpendicular to the planes of the first and second sides, the second ends of the first and second shafts being attached to first and second retainers, respectively, and being unattached to any other structure; and first and second rollers each having an axis, each of the first and second rollers defining a bore along its axis, the bores of the first and second rollers being arranged for receiving the first and second shafts therethrough, respectively, the first and second rollers having first and second end sections with a first outer diameter and a middle section with a second outer diameter, the first outer diameter being greater than the second outer diameter such that the first and second ends of the first and second rollers define shoulders, the first and second rollers being rotatably mounted about the first and second shafts such that the first and second rollers provide freely rotatable line-handling surfaces.

32. The bitt of claim 31, wherein the second ends of the first and second shafts are threaded, and the first and second retainers are threadedly received about the second ends of the first and second shafts.

33. The bitt of claim 31, wherein the rollers are made of a compressible material.

34. The bitt of claim 33, wherein the compressible material is polyurethane.

35. The bitt of claim 31, wherein the angle formed between the first and second frame members approximately 90 degrees.

36. The bitt of claim 31, wherein the frame is made of unitary construction.

37. The bitt of claim 31, wherein the first side of the frame and the second side of the frame are separate members.

38. A bitt with a freely rotatable line-handling surface, comprising:

a substantially planar base having an upper surface and a lower surface, the lower surface being arranged for being mounted on a surface of a marine vessel;

a frame assembly having first and second substantially planar sides, the first and second sides having first and second ends, the first and second sides adjoining each other at their first ends and defining a non-zero angle therebetween that is approximately 90 degrees, the first and second sides being attached to their upper surface of the base at the second ends;

first and second shafts each having first and second ends and an axis, the first and second shafts being attached to the first and second sides at the first end of the shafts, the axes of the first and second shafts extending outwardly from the first and second sides substantially perpendicular to the planes of the first and second sides first and second retainers attached to the second ends of the first and second shafts, respectively, the second ends of the first and second shafts being threaded, such that the first and second retainers are threadedly received about the second ends of the first and second shafts, respectively, the second ends of the shafts being unattached to any other structure: and first and second rollers each having an axis, the first and second rollers being made of a compressible material, each of the first and second rollers defining a bore along its axis, the bores of the first and second rollers being arranged for receiving the first arid second shafts therethrough, respectively, the first and second rollers having first and second end sections with a first out diameter and a middle section with a second outer diameter, the first outer diameter being greater than the second outer diameter such that the first and second ends of the first and second rollers define shoulders, the first and second rollers being rotatably mounted about the first and second shafts such that the first and second rollers provide freely rotatable line-handling surfaces.

39. The bitt of claim 38, wherein the frame is made of unitary construction.

40. The bitt of claim 38, wherein the first side of the frame and the second side of the frame are separate members.

* * * * *